United States Patent [19]

Colton

[11] 3,944,233

[45] Mar. 16, 1976

[54] GOLF CLUB SWING TRAINING DEVICE

[76] Inventor: Roland J. Colton, 41 Vista Way, Port Washington, N.Y. 11050

[22] Filed: Jan. 29, 1975

[21] Appl. No.: 545,099

[52] U.S. Cl. ..... 273/186 R; 273/200 R

[51] Int. Cl.[2] ..... A63B 69/36

[58] Field of Search .... 273/186, 200, 184 B, 185 B, 273/196, 197, 198

[56] References Cited

UNITED STATES PATENTS

| | | | |
|---|---|---|---|
| 1,596,919 | 8/1926 | Burgoyne | 273/186 R |
| 3,164,386 | 1/1965 | Fink | 273/200 B X |
| 3,554,555 | 1/1971 | Macri | 273/186 R |

FOREIGN PATENTS OR APPLICATIONS

| | | | |
|---|---|---|---|
| 426,822 | 4/1935 | United Kingdom | 273/186 R |

*Primary Examiner*—George J. Marlo
*Attorney, Agent, or Firm*—Jordan B. Bierman; Linda Bierman; Kenneth J. Stempler

[57] ABSTRACT

An upper and a lower flexible plastic telltale arm, each capable of limited rotation on a vertical supporting hinge-pin which is common to both telltales which are spaced vertically apart with ample space between the said telltales to allow a golf clubhead to freely pass between the said telltales without contacting either telltale, a yielding target in the well known form of a simulated golf ball normally supported at the end of a flexible plastic arm which arm is the carrier of the target which normally is interposed between the upper and the lower telltales each of which is capable of moving to a new position and remaining in the new position whenever either of the telltales is struck by the golfclub due to an improper "swing."

4 Claims, 3 Drawing Figures

GOLF CLUB SWING TRAINING DEVICE

Heretofore golf-swing training devices have been provided with telltales wherein the telltale returns to the "striking" position after having been struck by the golfclub while the golfer had difficulty in observing the telltale due to the high speed of the return action.

My invention reduces the number of elements embodied in a golf training device which is adapted to provide information as to the height of the golf clubhead in relation to the center of the target at the instant the target is struck by the golfclub, while the structure affords variation to accommodate right handed or left handed golfers by the simple expedient of inverting the target carrier arm, while the target may be located as on the "tee" or as in the "fairway" where the target rests on the ground with the lower telltale moved out of the path of the clubhead while the upper telltale will be the only functional signalling means when the "swing" is too high. Obviously the anchoring means would have to be inclined away from the perpendicular in order to place the target on the playing surface.

As the telltale elements are of the non-return classification, where they are moved out of the normal position whenever they are contacted by the golf club, it is necessary to manually reset the said telltales after each erratic "swing".

Referring now to the drawings in which like numerals refer to like parts;

Figure 1:
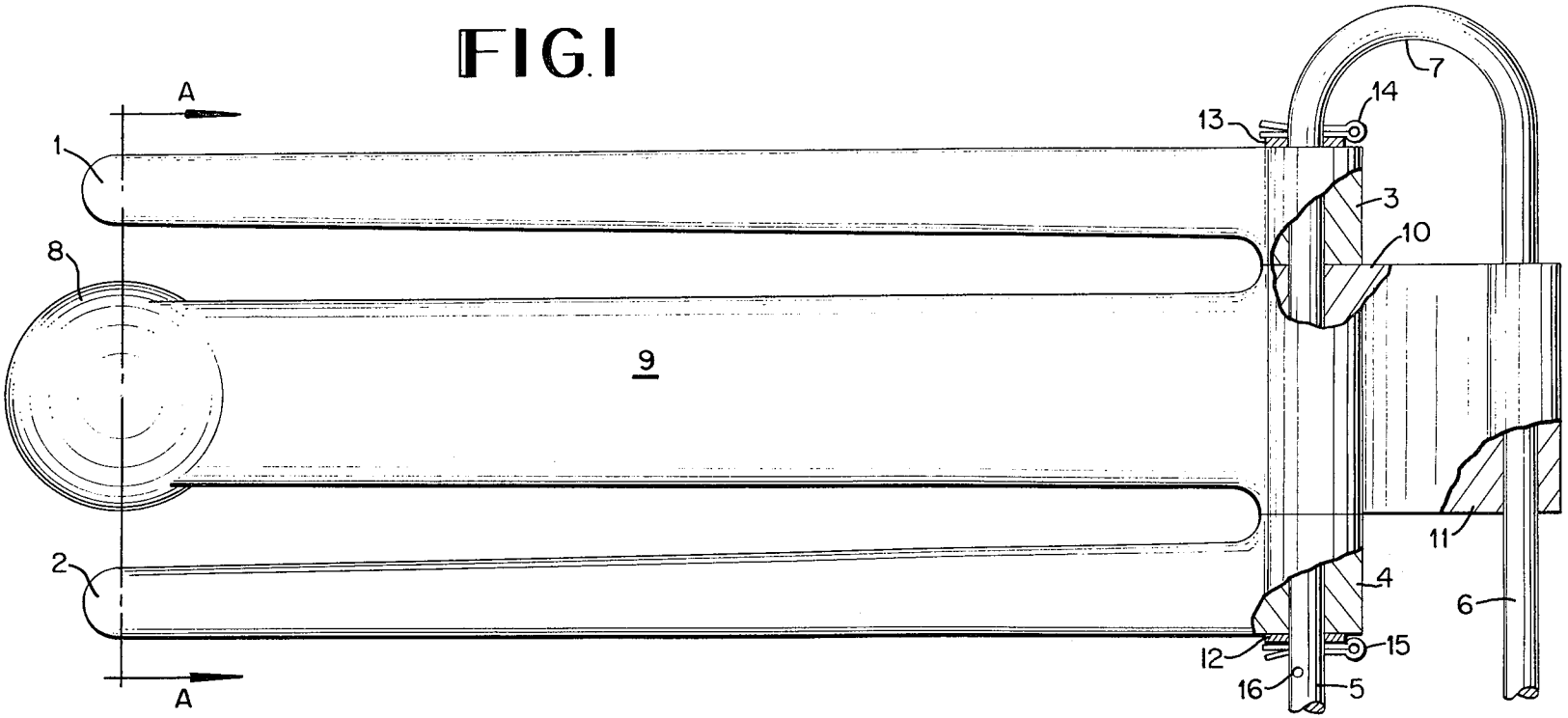
FIG. 1 is a side plan view of the apparatus of the invention.

Persons versed in the arts to which my invention pertains may be enabled to make and use this device by referring to the specifications where golfing terms are in quotes, and the drawings in which FIG. 1 shows the complete assembly of the elements combined to make this device which is poised in the normal position and seen from the striking side where the golfer is right handed and the elements 5 and 6 are the stabilizing elements which are essentially two legs of a large metal staple embedded in solid substance such as the playing surface. The upper telltale is indicated at 1, with the lower telltale shown at 2 with the telltales pivotally supported at 3 and 4 by the element 5 which functions as a hinge-pin common to both telltales. The element 5 is also part of an anchoring means in cooperation with the element 6 which is integral element 5 and embodies a return bend indicated at 7, thus forming a large metal staple having parallel legs sharply pointed to provide an easy means for forcing the staple into the playing surface.

The target may be in the form of the well known simulated golf ball shown at 8 while attached to the moveable end of the carrier arm indicated at 9 which is normally held in the position shown by the elements 5 and 6 which pass through the perforations in the base of the carrier arm as indicated at 10 and 11. A metallic washer is shown at 12, with a second washer shown at 13, each being firmly held against the telltales 1 and 2 to the extent that the elements 1, 2 and 9 are in a compressed state one against the other, with cotter pins indicated at 14 and 15 fixing the position of the said washers which compress the three elements 1, 2 and 9.

Figure 2:
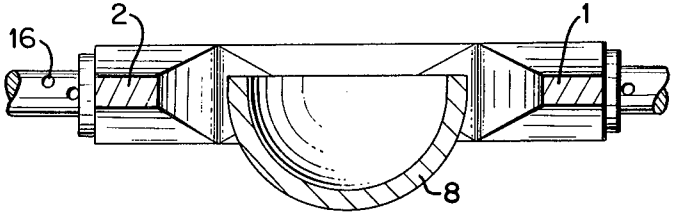
FIG. 2 is a detailed view of the apparatus of FIG. 1 taken along line A—A FIG. 1.

FIG. 2 is a sectional view of my invention which is indicated by the broken line A A in FIG. 1., with upper telltale shown in section at 1, lower telltale shown in section at 2, while the target is shown in section at 8, with an extra cotter pin hole indicated at 16 which pin hole is provided to allow adjustment in the space between the telltales and the target carrier arm 9 where additional washers may be inserted to provide the desired adjustment.

Figure 3:
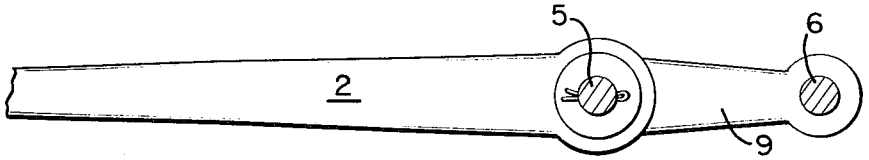
FIG. 3 is a bottom view of the apparatus of FIG. 1.

FIG. 3 shows the underside of the elements showm in FIG. 1 with part of the lower telltale 2 and the base of the target carrier arm 9. As previously stated, the three elements 1, 2 and 9 are held in a state of compression which state imposes a friction load on the hinge part of the telltales as they are forced on the hinge pin 5 and against the stationary base of the element 9, with the aforesaid friction load providing means to prevent a rebound action of the telltales after being struck by the golfclub when the "swing" is inaccurate. While the carrier arm and the telltales cooperate in providing a non-return characteristic embodied in the telltales they also prevent undesired movement of the telltale elements due to air turbulence caused by the close proximity of the fast moving golfclub.

Without departing from the spirit of my invention, any materials may be substituded for the materials preferred by me, while the perforations within the telltales may embody a binding fit where the hinge-pin is slightly larger than the perforations embodied in the flexible telltale.

Having described my invention, I claim:

1. A golf training device comprising a U-shaped support, a pair of elongated arms of substantially the same length pivotally mounted on one of the legs of said support, said arms being spaced from each other along said leg; a target carrier non-rotatably mounted on said support and between said elongated arms and having a target on the end thereof remote from said support, said target being positioned between said arms so that a golf club improperly swung will contact one of said arms and when properly swung will contact only said target, means for preventing the return of an arm to its original position after it has been struck and caused to pivot on said one leg.

2. The golf training device according to claim 1 wherein said means for preventing the return of the arm to its original position comprises a first annular collar positioned above the elongated arm closest to the bend of said U-shaped element and means for pressing said first annular collar against its associated elongated arm to cause the elongated arm to frictionally engage the target carrier; and a second annular collar positioned below the other elongated arm, and means for pressing the second annular collar against its associated elongated arm to cause said elongated arm to frictionally engage the target carrier.

3. The golf training device according to claim 2 further comprising at least two perforations in the leg on which said elongated arms are mounted, at least one of said perforations being located adjacent to said first annular collar and another of said perforations being located adjacent said second annular collar, and a pin mounted in each of said perforations to anchor said collars against their associated elongated arms.

4. The golf training device according to claim 1 wherein the end of said target carrier remote from said target is provided with a pair of bores for engaging both of said legs.

* * * * *